US005189384A

United States Patent [19]

Milianowicz et al.

[11] Patent Number: 5,189,384

[45] Date of Patent: Feb. 23, 1993

[54] CIRCUIT BREAKER HAVING IMPROVED CONTACT STRUCTURE

[75] Inventors: Stanislaw A. Milianowicz, Monroeville; Russell W. Long, Pleasant Hills; Alexander V. Donatelli, Wilkinsburg, all of Pa.

[73] Assignee: Westinghouse Electric Corp., Pittsburgh, Pa.

[21] Appl. No.: 788,692

[22] Filed: Nov. 6, 1991

[51] Int. Cl.[5] ..... H01H 75/00

[52] U.S. Cl. ..... 335/16; 335/195; 200/147 R

[58] Field of Search ..... 335/16, 147, 145; 200/144 R, 147 R

[56] References Cited

U.S. PATENT DOCUMENTS

| | | | |
|---|---|---|---|
| 3,550,049 | 12/1970 | Blanc-Tailleur | 335/147 |
| 3,593,227 | 7/1971 | Mitskevich et al. | 335/195 |
| 3,921,109 | 11/1975 | Hodgson . | |
| 4,121,067 | 10/1978 | Rexroad et al. . | |
| 4,162,467 | 7/1979 | Cellerini et al. . | |
| 4,467,301 | 8/1984 | Goodrich | 335/195 |
| 4,511,774 | 4/1985 | Forsell | 200/147 R |
| 4,654,490 | 3/1987 | Leone et al. . | |
| 4,654,491 | 3/1987 | Maier et al. . | |
| 4,968,859 | 11/1990 | Davies et al. . | |
| 4,973,805 | 11/1990 | Paton et al. . | |
| 5,073,764 | 12/1991 | Takanashi et al. | 335/16 |

OTHER PUBLICATIONS

Pp. 38–45 and 74–77 of I. B. 33-790-1F, Oct. 1983 entitled "Instructions for Low-Voltage Power Circuit Breakers Types DS and DSL" Published by Westinghouse Electric Corporation.

*Primary Examiner*—Lincoln Donovan
*Attorney, Agent, or Firm*—M. J. Moran

[57] ABSTRACT

A power circuit breaker having movable and relatively stationary contact assemblies operable between open and closed positions. The contact assemblies respectively include pivotally mounted first and second conductive members. The first and second conductive members are disposed in spaced relation in the closed position of the circuit breaker, to provide a first current loop having first and second legs defined by said first and second conductive members. A pivotable mounting arrangement for the second conductive member provides a second current loop defined by the second leg portion of the first loop and a third leg portion. The magnetic forces in the first current loop, which tend to pivot the second leg portion towards the third leg portion, are opposed by magnetic forces in the second current loop. Compression spacers provide parallel current paths which reduce the magnitude of current flowing through a pivotable joint of the relatively stationary contact assembly.

11 Claims, 5 Drawing Sheets

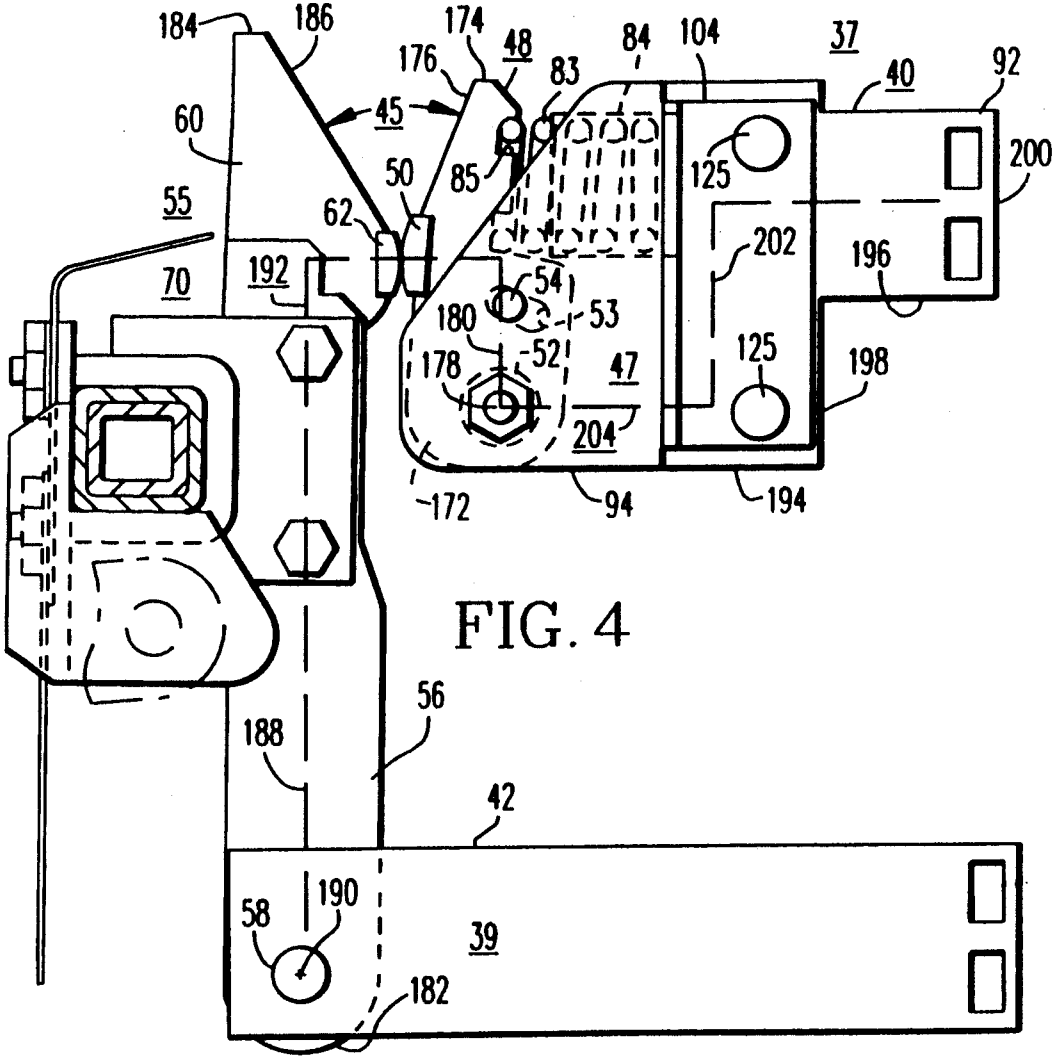
FIG. 4
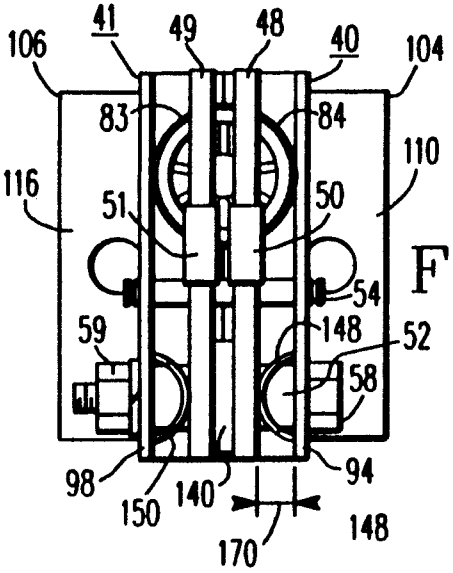
FIG. 5
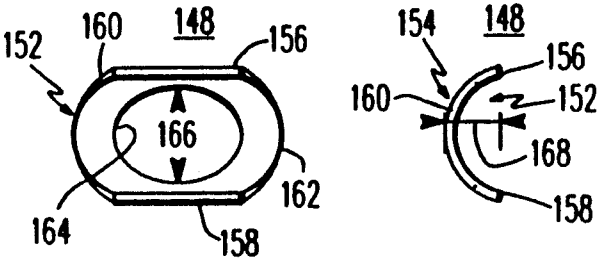
FIG. 6
FIG. 7

CIRCUIT BREAKER HAVING IMPROVED CONTACT STRUCTURE

TECHNICAL FIELD

The invention relates in general to power circuit breakers, and more specifically to electrical contact structures for power circuit breakers.

BACKGROUND ART

Prior art circuit breakers conventionally utilize both main and arcing contact tips carried by the movable and stationary contact assemblies, with the arcing contact tips, and arrangements for causing the arcing contact tips to separate after separation of the main contact tips, adding to the manufacturing and maintenance costs.

Prior art power circuit breakers create a magnetic repulsion force between the movable and stationary contact assemblies due to current flow therethrough in opposite directions. While some magnetic repulsion is desirable, as it aids in quick separation of the movable and stationary contacts when the circuit breaker is tripped under load, short circuit currents can provide magnetic forces having magnitudes sufficiently great to damage mechanical components of the contact assemblies.

Prior art power circuit breakers conventionally pivot one or more main contact fingers of the stationary contact assembly, with load and short circuit currents being required to flow through the pivotable joint. Currents of high magnitude can cause the pivotable parts to weld, destroying necessary functions of the main contact fingers of the stationary contact assembly.

Thus, it would be desirable, and it is an object of the present invention, to eliminate arcing contact tips in a power circuit breaker, and thus the costly arrangements for causing arcing contact tips to separate after main contact tips have separated. It would also be desirable, and it is another object of the invention, to reduce the magnitude of the magnetic forces which operate upon the stationary contact assembly, to reduce the chance of damaging components thereof during heavy current flow. It would also be desirable, and it is another object of the invention, to reduce the magnitude of the current flow through pivotable joints of independent contact fingers of the stationary contact assembly, to reduce the chance of overheating and welding occurring in these joints.

SUMMARY OF THE INVENTION

Briefly, the present invention is a power circuit breaker having movable and relatively stationary contact assemblies, with the movable contact assembly being operable between closed and open positions relative to the stationary contact assembly. The movable and relatively stationary contact assemblies respectively include first and second pivotally mounted conductive members. A main contact tip is provided on each of the first and second conductive members, with these main contact tips being the only engageable contact tips carried by said first and second conductive members.

The means which pivotally mounts the second conductive member includes a pivot axis which is spaced from the associated contact tip to provide a substantial current path therethrough. The first and second conductive members are disposed in spaced, substantially parallel relation when the movable contact assembly is in the closed position, to provide a first current loop having first and second legs defined by said first and second conductive members, which legs are arranged to provide current flow in opposite directions.

The means which pivotally mounts the second conductive member directs current flow in a path which is spaced from and substantially parallel to the second leg of the first current loop, to provide a second current loop defined by the second leg portion of the first loop and a third leg portion, which legs are arranged to provide current flow having oppositely directed current components.

Magnetic forces in the first current loop which tend to pivot the second leg portion towards the third leg portion, are opposed by magnetic forces in the second current loop which tend to pivot the second leg portion towards the first leg portion, providing a net reduction in the magnitude of the magnetic force tending to separate the second leg portion from the first leg portion.

In another aspect of the invention, the power circuit breaker includes movable and relatively stationary contact assemblies, with the movable contact assembly being operable between closed and open positions relative to the stationary contact assembly. The movable and relatively stationary contact assemblies respectively have pivotally mounted first and second conductive members.

The means which pivotally mounts the second conductive member includes a fixed bearing member having first and second ends, with the second conductive member being mounted on said fixed bearing member with a snug but rotatable fit to define a first joint. The means which pivotally mounts the second conductive member further includes first and second pole stud members, and means for clamping the first and second ends of the fixed bearing member between the first and second pole stud members, to provide second and third joints. A first current path is provided which includes the second conductive member, the first joint, the fixed bearing member, the second joint, and the first pole stud member. A second current path is provided which includes the second conductive member, the first joint, the fixed bearing member, the third joint, and the second pole stud member. First conductor means is provided which establishes a third current path, with the third current path being electrically in parallel with the first current path. Second conductor means is provided which establishes a fourth current path, with the fourth current path being electrically in parallel with the second current path. The first and second conductor means additionally provide the function of maintaining the second conductive member centered on the fixed bearing member. The first and second conductor means are preferably in the form of first and second compression spacer members, respectively, which are washer-like members having a substantially C-shaped cross sectional configuration. The first compression spacer member is compressed between the second conductive member and the first pole stud member, to establish the third current path directly therebetween, and the second compression spacer member is compressed between the second conductive member and the second pole stud member, to establish the fourth current path directly therebetween.

BRIEF DESCRIPTION OF THE DRAWINGS

The invention will become more apparent by reading the following detailed description in conjunction with the drawings, which are shown by way of example only, wherein:

FIG. 4 is a relatively larger side elevational view of the movable and relatively stationary contact assemblies shown in FIGS. 1 and 2, illustrating first and second current loops which reduce the magnitude of magnetic forces operating upon a common leg of the first and second loops;

FIG. 5 is a front elevational view of the relatively stationary contact assembly shown in FIG. 4, illustrating an aspect of the invention in which current flow through a pivotable interface is reduced by parallel electrical circuits established by compression spacer members, which additionally provide the function of exerting centering forces on pivotable members of the relatively stationary contact assembly;

FIG. 6 is a side elevational view of one of the compression spacer members shown in FIG. 5, showing the concave side thereof;

FIG. 7 is an edge elevational view of the compression spacer member shown in FIG. 6;

DESCRIPTION OF PREFERRED EMBODIMENTS

Figure 1:
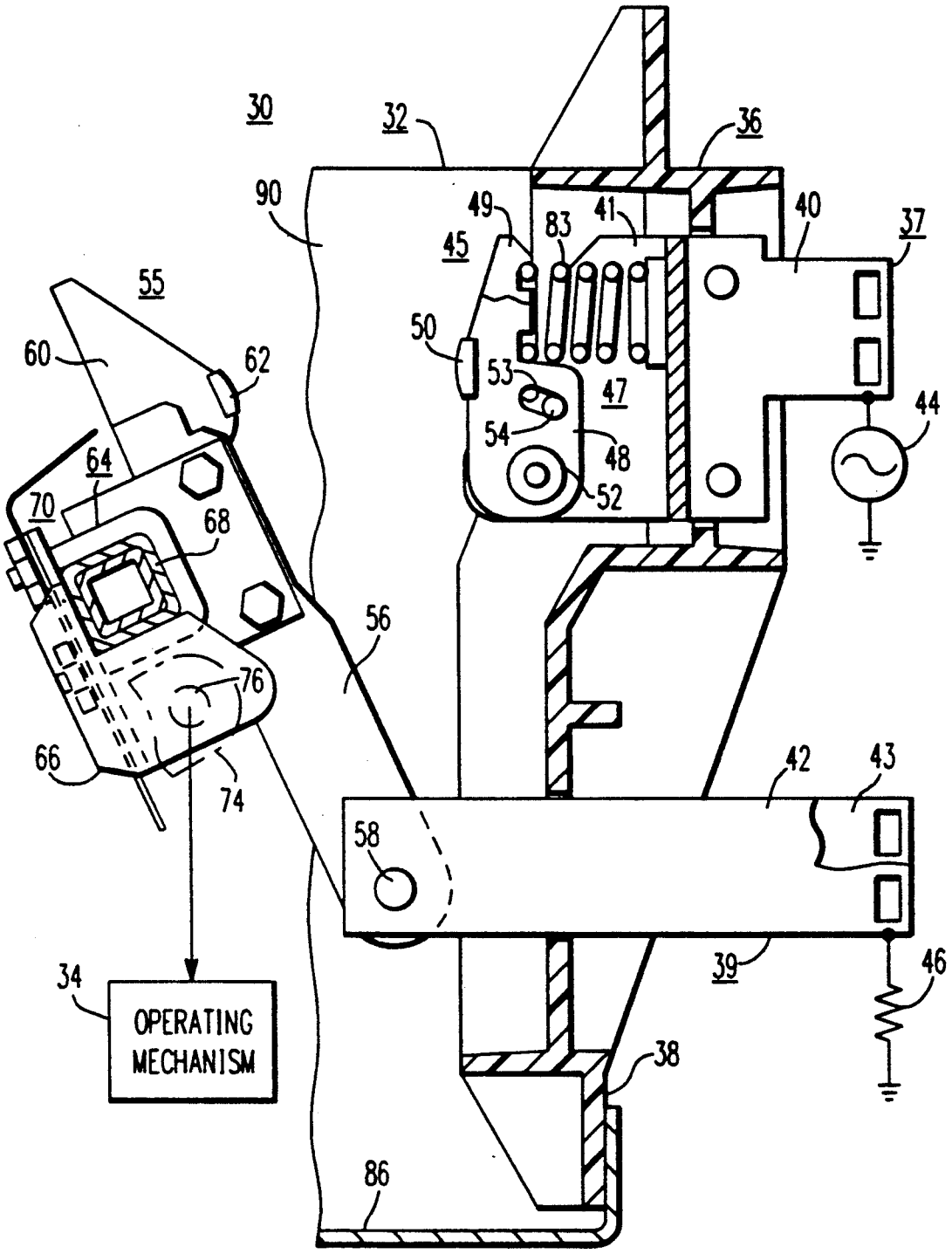
FIG. 1 is a fragmentary side elevational view of a circuit breaker having movable and relatively stationary electrical contact assemblies shown in the open or tripped position, with the electrical contact assemblies being constructed according to the teachings of the invention.
Figure 2:
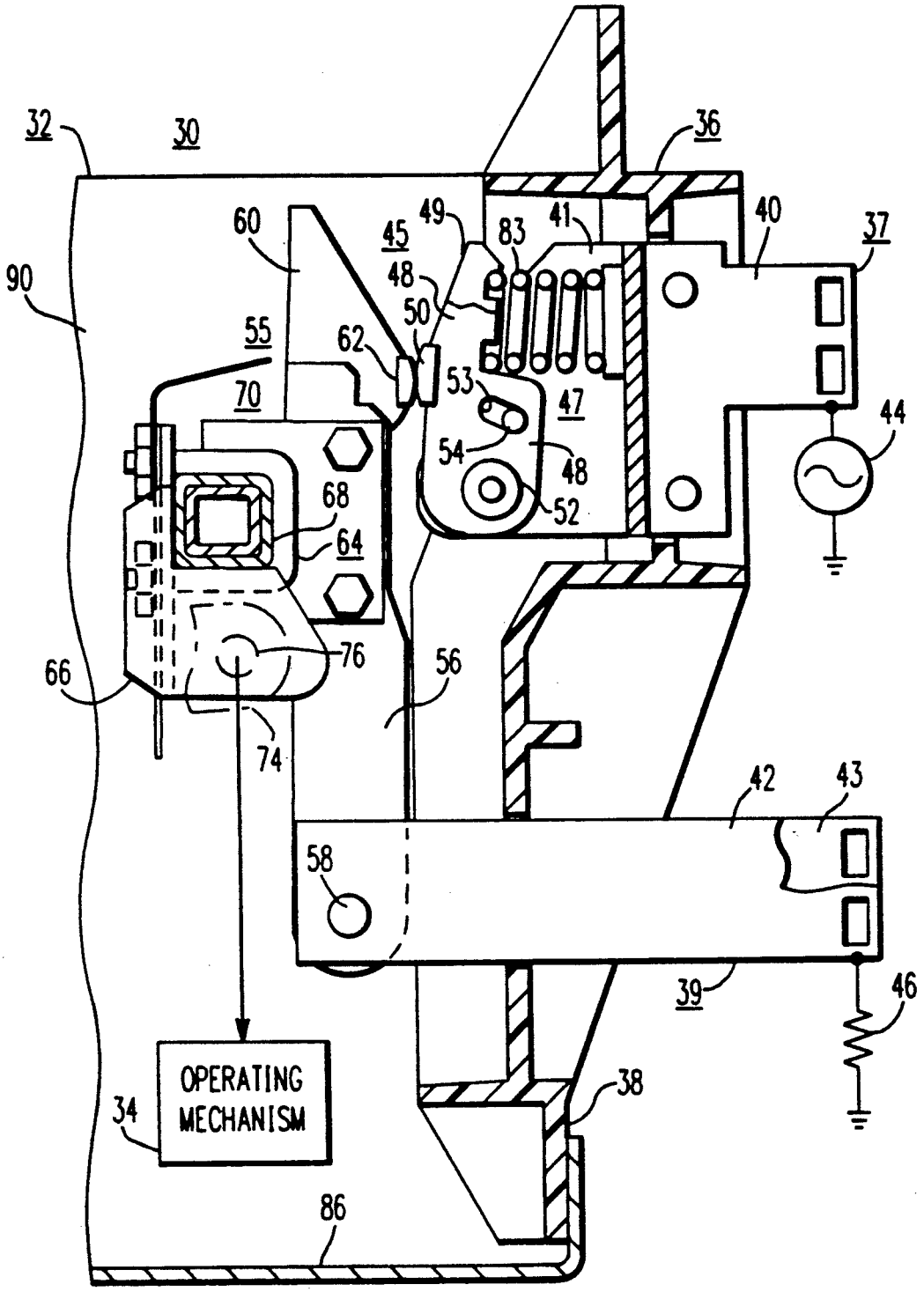
FIG. 2 is a fragmentary side elevational view, similar to FIG. 1, except illustrating the movable and relatively stationary electrical contact assemblies in a closed position.

Referring now to the drawings, and to FIGS. 1 and 2 in particular, there is shown fragmentary side elevational views, partially in section, of a circuit breaker 30 constructed according to the teachings of the invention. For purposes of example, circuit breaker 30 is illustrated as being of the AC power circuit breaker type which is usually supplied as part of low voltage metal enclosed switchgear of the drawout type, but it may also be supplied in a fixed mounted version, as desired. Further, the principles and teachings set forth herein apply equally to any low voltage power circuit breaker which must be able to successfully interrupt large short circuit currents while mechanically withstanding the associated magnetic forces.

Circuit breaker 30 includes a chassis 32, which may be metal, such as steel, with chassis 32 supporting all of the circuit breaker components which include an operating mechanism 34 of any suitable type, and three insulated pole assemblies 36 (with three-phase breakers), only the center one of which is illustrated, since they are of similar construction. As is well known in the art, operating mechanism 34 includes a stored energy arrangement for closing circuit breaker 30, and a trip mechanism for opening it.

Each pole unit assembly 36 includes an insulative pole base 38 formed of a good electrical insulating material, such as a glass polyester, an upper pole stud assembly 37 which includes first and second metallic upper pole stud members 40 and 41, and a lower pole stud assembly 39 which includes first and second metallic lower pole stud members 42 and 43. The upper pole stud assembly 37 is connected to a power source 44 and the lower pole stud assembly 39 is connected to an electrical load 46, or vice versa.

Figure 3:
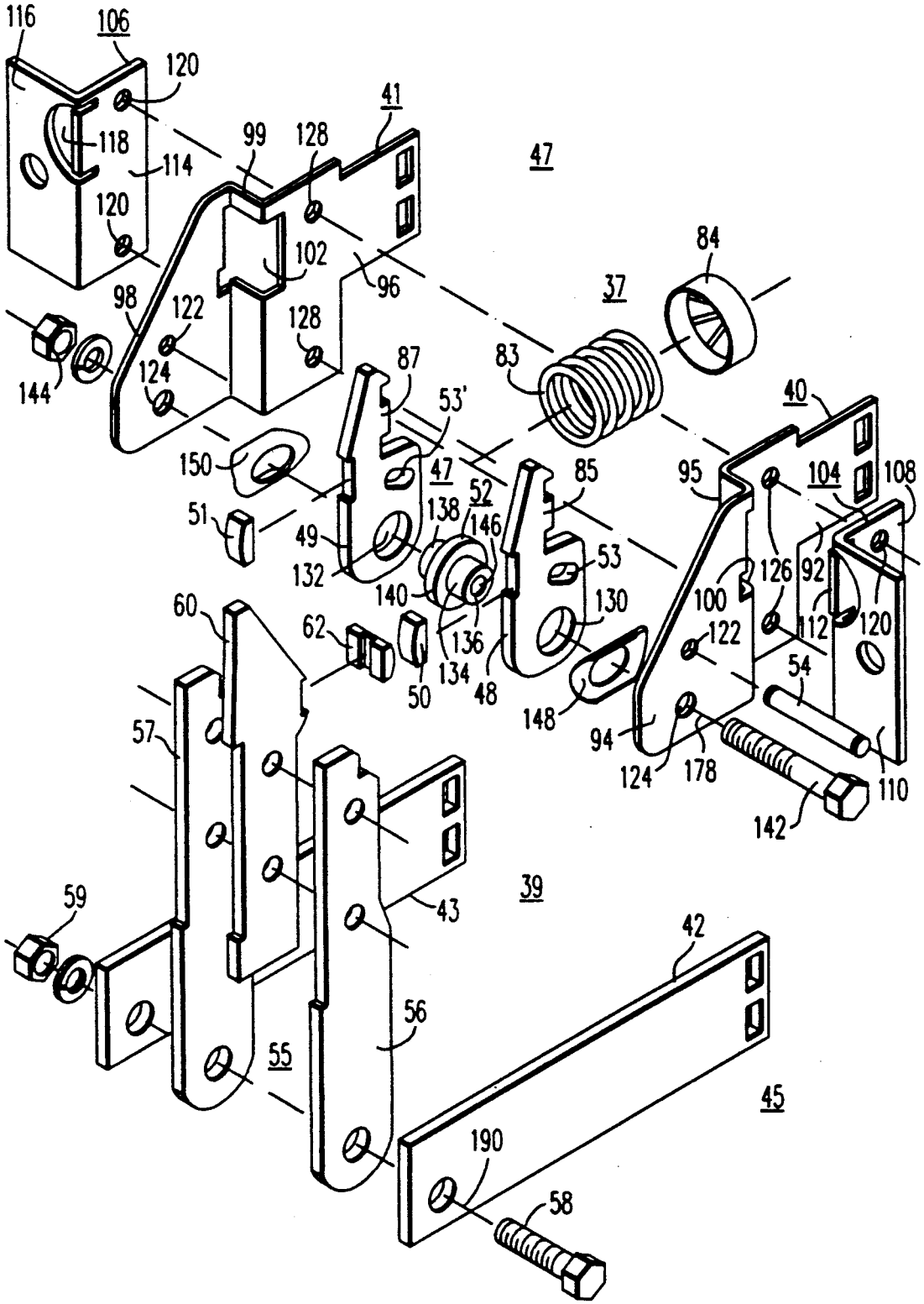
FIG. 3 is an exploded view of the movable and relatively stationary contact assemblies shown in Figures 1 and 2.

Each pole unit assembly 36 further includes an electrical contact structure 45, with contact structure 45 including a relatively stationary electrical contact assembly 47 and a movable contact assembly 55. FIG. 3 is an exploded perspective view of the upper and lower stud assemblies 37 and 39, the relatively stationary electrical contact assembly 47, and the movable contact assembly 55. FIG. 4 is an enlarged view of the contact structure 45 shown in FIG. 2, and FIG. 5 is a front elevational view of the relatively stationary contact assembly 47. All of the aforesaid Figures will be referred to in the following more detailed description.

The relatively stationary contact assembly 47 has a predetermined number of pairs of metallic contact fingers or heads, depending upon the current rating of circuit breaker 30, with a single pair comprising first and second contact fingers 48 and 49 being illustrated for purposes of example in this first embodiment of the invention. Contact finger 48 carries a metallic main contact tip 50, and contact finger 49 carries a metallic main contact tip 51 (FIGS. 3 and 5), which are silver soldered to the associated contact fingers. Contact fingers 48 and 49 are mounted for limited pivotal movement on the upper pole stud 40 via a tubular metallic support bearing 52, and via movement limiting means comprising slots 53 and 53' in contact fingers 48 and 49, respectively, and stp pin 54 which extends through both slots.

Movable contact assembly 55 of contact structure 45 has a predetermined number of metallic contact arms, with the number depending upon the current rating of circuit breaker 30, with first and second contact arms 56 and 57 being illustrated for purposes of example. The first and second contact arms 56 and 57 are pivotally mounted on the lower pole stud 42 via a pivot pin 58. As illustrated in FIGS. 3 and 5, pivot pin 58 may be a bolt having a nut 59, which combination maintains the relatively stationary contact assembly 47 in assembled relation.

A predetermined number of metallic contact heads are supported by the contact arms, with the number depending upon the current rating of circuit breaker 30. For purposes of example, a single contact head 60 is illustrated. Contact head 60 carries a metallic contact tip 62 which is wide enough to contact both main contact tips 50 and 51 of the relatively stationary contact assembly 47.

An insulative drive bar arrangement 64, which includes a drive bar yoke 66 and an elongated drive bar 68, interconnects the movable contact assemblies 55 of the three pole units 36 for simultaneous movement thereof. For simplicity, the complete assembly of the three movable contact assemblies 55 and drive bar arrangement 64 will be hereinafter referred to as movable contact means 70 of circuit breaker 30.

A plurality of insulative links 74, shown in phantom, interconnect operating mechanism 34 with a pivot pin 76 disposed on the yoke 66 of the center pole assembly 36.

When circuit breaker 30 is in the closed position shown in FIG. 2, each movable contact assembly 55 applies a force to the associated stationary contact assembly 47, pivoting the stationary contact assembly 47 through the limited movement allowed, compressing or biasing a compression spring 83 associated with each pair of contact fingers in each pole unit 36. A first end of compression spring 83 simultaneously engages bosses 85 and 87 on contact fingers 48 and 49, respectively, and the remaining or second end of compression spring 83 is supported by a suitable spring seat formed in the upper stud members. The second end is disposed within a tubular insulative member 84 which prevents current flow through the compression spring 83 to the supporting upper stud members 40 and 41.

When operating mechanism 34 trips circuit breaker 30, movable contact means 70 is propelled to the open position shown in FIG. 1, due to forces stored in springs 83, forces stored in other springs (not shown) which are charged when movable contact means 70 moves to the closed position shown in FIG. 2, such as tension springs connected between an insulative portion of the movable contact means 70 and chassis 32, and due to magnetic forces produced when circuit breaker 30 is opened under load.

Chassis 32 includes a plurality of assembled sheet metal members which define bottom, top, front and side portions of chassis 32, with only a bottom 86 and a single side 90 being illustrated in the figures.

Returning to the embodiment of the relatively stationary contact assembly 47 shown in FIGS. 1 through 4, the first metallic upper pole stud 40 is formed to provide a substantially S-shaped configuration, when viewed from an upper edge, including first and second offset, but parallel, leg portions 92 and 94, respectively, joined by an intermediate portion 95. The bottom edge of the first leg portion 92 is vertically offset in an upward direction from the bottom edge of the second leg portion 94, creating a large vertical component in current flowing between the two leg portions.

The second upper pole stud 41 is similar to the first upper pole stud 40, except it is formed to provide a substantially Z-shaped configuration, when viewed from an upper edge, including first and second offset, but parallel, leg portions 96 and 98, respectively, joined by an intermediate portion 99. The bottom edge of the first leg portion 96 is vertically offset in an upward direction from the bottom edge of the second leg portion 98. Openings 100 and 102 are respectively provided in the intermediate portions 95 and 99.

First and second metallic upper stud mounting brackets 104 and 106 are provided for securely mounting the upper stud assembly 37 to the insulative pole base 38. Mounting bracket 104 is a right angle member having first and second leg portions 108 and 110, respectively, with an opening 112 being provided at the transition between leg portions 108 and 110. Mounting bracket 106 is a right angle member having first and second leg portions 114 and 116, respectively, with an opening 118 being provided at the transition between leg portions 114 and 116. The first leg portions 108 and 114 each have a pair of openings, all referenced 120, and the second leg portions 94 and 98 have first openings 122 for supporting stop pin 54, and second openings 124.

The first leg portions 108 and 114 of the first and second mounting brackets 104 and 106 and the first leg portions 92 and 96 of the first and second upper pole studs 40 and 41, are sandwiched tightly together and held by rivets 125 (FIG. 4), or other suitable fasteners, which extend through openings 120 of the mounting brackets and openings 126 and 128 of the upper pole studs. Openings 100, 102, 112 and 118 of the upper pole studs 40 and 41 and of the first and second mounting brackets 104 and 106 cooperatively form a spring pocket or seat for holding the end of compression spring 83 which is electrically insulated by tubular insulative member 84.

As shown in the exploded perspective view of FIG. 3, contact fingers 48 and 49 include openings 130 and 132, respectively, which are dimensioned to snugly but slidably receive the diameter of tubular support bearing 52, with the diameter being defined by outer surface 134 which extends between first and second longitudinal ends 136 and 138, respectively, of the tubular bearing member 52.

Contact fingers 48 and 49 are slidably disposed on surface 134 of support bearing 52, with contact fingers 48 and 49 being spaced by a predetermined small dimension via a metallic washer member 140 which is also snugly but slidably disposed on outer surface 134. Support bearing 52 is fixed between the second leg portions 94 and 98 of the upper pole studs 40 and 41 by a bolt 142 and nut 144, with bolt 142 extending through openings 124 of the upper pole studs 40 and 41 and through an opening 146 in support bearing 52.

Current flow through the first contact finger 48 includes a first joint formed between the surface which defines opening 130 and outer surface 134 of support bearing 52. The current through this joint divides into first and second current paths which respectively include second and third joints. The second and third joints are respectively formed between the first and second ends 136 and 138 of support bearing 52 and the second leg portions 94 and 98 of the first and second upper pole studs 40 and 41. In like manner, current flow through the second contact finger 49 includes a first joint formed between the surface which defines opening 132 and outer surface 134 of support bearing 52. The current through this joint divides into the hereinbefore mentioned first and second current paths which include the second and third joints which are respectively formed between the first and second ends 136 and 138 of support bearing 52 and the second leg portions 94 and 98 of the first and second upper pole studs 40 and 41.

Currents of high magnitude flowing between the support bearing 52 and contact fingers 48 and 49 can cause $I^2R$ losses in the joints sufficient to cause localized welding, which would necessitate maintenance of the relatively stationary contact assembly 47. To reduce the chances of such welding, current flow through the first and second current paths is significantly reduced by providing means which establishes a third current path, which is electrically in parallel with the first current path, and by providing means which establishes a fourth current path, which is electrically in parallel with the second current path.

The means which establishes the third and fourth current paths is in the form of first and second metallic compression spacer members 148 and 150, shown in edge views in FIGS. 5 and 7, and in a side elevational view in FIG. 6. Compression spacer members 148 and 150, which may be formed of copper, for example, are identical, and thus only compression spacer member 148 will be described in detail.

Figure 9:
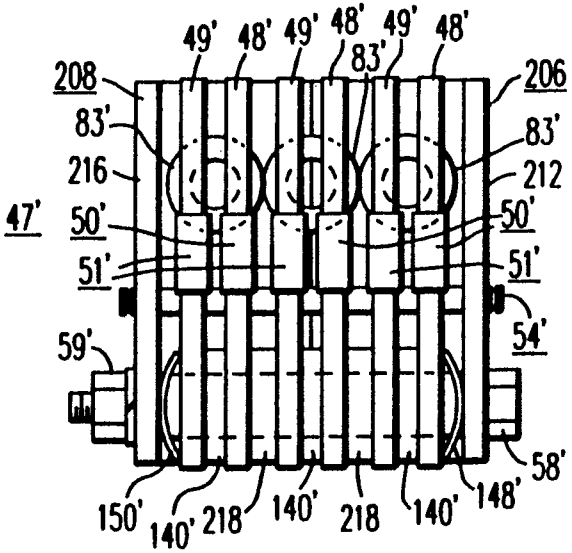
FIG. 9 is a front elevational view of the stationary contact assembly shown in FIG. 8, illustrating compression spacer members applied according to the teachings of the invention.

Compression spacer member 148, as shown in FIGS. 6 and 7, has a substantially C-shaped cross sectional configuration, having concave and convex sides 152 and 154, respectively. Compression spacer member 148 includes first and second flat edges 156 and 158 joined by first and second curved side portions 160 and 162. A central opening 164 is provided through compression spacer member 148, a narrow dimension 166 of which is sized to enable compression spacer members 148 and 150 to slide on support bearing 52. Compression spacer members 148 and 150 are preferably disposed on support bearing 52 such that their convex sides 154 respectively engage contact fingers 48 and 49, as it is easier during assembly to maintain them on support bearing. Functionally they may be reversed, as illustrated in the embodiment of FIG. 9, such that their convex sides respectively engage upper pole stud members 40 and 41.

The unstressed longitudinal dimension 168 of compression spacer member, shown in FIG. 7, is selected to exceed the fixed dimension 170 shown in FIG. 5, with dimension 170 being between a contact finger and the second leg portion of an upper pole stud, such as between contact finger 48 and the second leg portion 94 of upper pole stud 40. Thus, when bolt 58 and nut 59, or other suitable fastener means, are tightened to force the second leg portions 94 and 98 tightly against the first and second ends 136 and 138 of support bearing 52, each compression spacer member 148 and 150 will be compressed and stressed to a smaller longitudinal dimension, which assures good electrical contact between the convex sides 154 of the compression spacer members 148 and 150 and contact fingers 48 and 49, and between the ends 156 and 158 of the compression spacer members 148 and 150 and the second leg portions 94 and 98 of the first and second upper pole studs 40 and 41. The compression of the compression spacer members 148 and 150 also provides equal centering forces on contact fingers 48 and 49, assuring that they will be in the desired positions for engagement between their contact tips 50 and 51 and the contact tip 62 of the movable contact assembly 55.

Compression spacer member 148 thus provides a third current path, which electrically parallels the first current path, and compression spacer member 150 provides a fourth current path, which electrically parallels the second current path, substantially reducing the magnitude of current flowing at any instant through the joints between contact fingers 48 and 49 and the support bearing 52. As best illustrated in FIG. 4, the main contact tips 50 and 51 of the relatively stationary contact assembly 47 and the main contact tip 62 of the movable contact assembly 55 are the only engageable contact tips in circuit breaker 30. Separate arcing contact tips are eliminated. Arrangements for insuring that arcing contact tips disengage after main contact tips are therefore not necessary.

Contact fingers 48 and 49 are of like construction, and thus only contact finger 48 will be described in detail. Contact finger 48 has first and second ends 172 and 174, with contact finger 48 being pivotally mounted adjacent to the first end 172. Contact tip 50 is spaced from the second end 174 by an arcing surface 176. The placement of contact tip 50 relative to a pivot axis 178 is selected to provide a substantial current path through contact finger 48, indicated by broken line 180, between contact tip 50 and support bearing 52, as well as a substantial arcing surface 176. Boss 85 is located such that compression spring 83 provides a biasing force on contact fingers 48 and 49 which is centered above contact tips 50 and 51, i.e., between the contact tips 50 and 51 and the second ends 174 of the contact fingers 48 and 49.

The movable contact assembly 55, which includes contact arms 56 and 57 and contact head 60, has first and second ends 182 and 184, with the assembly being pivotally mounted adjacent to the first end 182. Contact tip 62 is spaced from the second end 184 by an arcing surface 186. The dimension from contact tip 50 to the first end 182 is selected to provide a substantial current path through the assembly, indicated by broken line 188 between contact tip 62 and pivot axis 190, and a substantial arcing surface 186.

The arcing surfaces 176 and 186, which are disposed within an arc chute (not shown), start at the engagement of the main contact tips and diverge from one another, such as at an angle of about 60 degrees. Thus, when contact tip 62 moves out of engagement with contact tips 50 and 51 during a trip operation while circuit breaker 30 is carrying load or short circuit currents, the resulting arc moves upwardly between the parting arcing surfaces 176 and 1 86, being stretched cooled, and extinguished, in the arc chute, eliminating the need for separate arcing contact tips.

The two spaced current paths 188 and 180 form first and second legs of a first current loop 192, with current flow through legs 188 and 180 being in opposite directions. Current flow through the first loop 192 thus creates magnetic forces which tend to separate the legs 188 and 180, with the higher the current the greater the magnetic repulsion forces. While circuit breaker 30 is closed, these magnetic repulsion forces are undesirable, because they tend to separate the main contact tips. When circuit breaker 30 is tripped, these magnetic repulsion forces are desirable, because they add to the stored spring forces in quickly moving the movable contact means 70 away from the relatively stationary contact means 47.

The magnetic repulsion forces in the first current loop 192, however, can become so great that mechanical components of the contact structure 45 may be bent or otherwise damaged. The present invention reduces the magnitude of the magnetic forces operating upon the second leg 180 of current loop 192, to reduce the risk of component damage, while still preserving a net repulsion force between the first and second legs 188 and 180 which aids tripping. The upper pole studs 40 and 41 are of similar construction, so only upper pole stud 40 will be described in detail. The first leg portion 92 of upper pole stud 40 has first and second vertically spaced lower edges 194 and 196 which are joined by a vertical edge 198, to force current flowing between a connector end 200 of pole stud 40 and the region surrounding pivot axis 178 to have a substantial vertical component, indicated by broken line 202. Thus, a second current loop 204 is provided which includes the second leg 10 and a third leg in the form of current component 202.

The spacing between the second and third legs 180 and 202 of the second current loop 204 exceeds the spacing between the first and second legs 188 and 180 of the first loop, and thus the magnetic force which attempts to move the second leg 180 away from the third leg 202, is not as great as the magnetic force which attempts to move the second leg 180 away from the first leg 188, providing the desired net magnetic repulsion between the first and second legs 188 and 180 which aids tripping, while reducing the net force to a magnitude which reduces the chances of damaging components of the contact structure 45.

Figure 8:
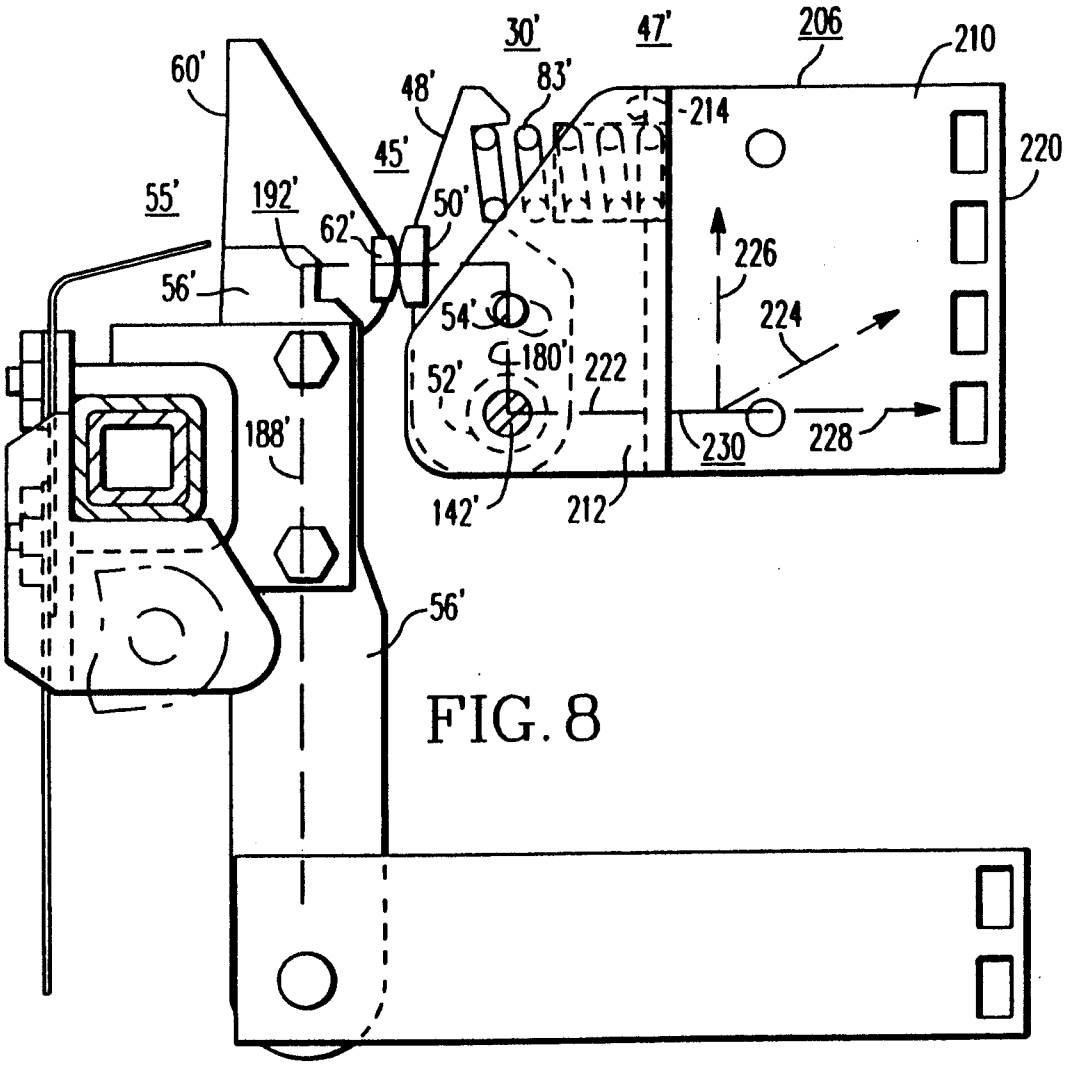
FIG. 8 is a side elevational view of circuit breaker contacts, similar to FIG. 4, except illustrating an embodiment of the invention in which the movable and stationary contacts of a circuit breaker have a higher current rating than the contacts of the circuit breaker shown in FIG. 4.

FIG. 8 is a side elevational view of a circuit breaker 30', which is similar to the view of circuit breaker 30 shown in FIG. 4, except illustrating the teachings of the invention applied a circuit breaker having a higher current rating than circuit breaker 30. FIG. 9 is a front elevational view of a stationary contact assembly 47' shown in FIG. 8. Elements of circuit breaker 30' which are similar to those of circuit breaker 30 are identified with the same reference numbers, except for the addition of a prime mark, and will not be described in detail. For purposes of example, stationary contact assembly 47' is illustrated (FIG. 9) having three pairs of contact fingers, with each pair having first and second contact fingers 48' and 49'. Each pair of contact fingers has its own cooperative compression spring 83'. The movable contact assembly 55' is made up of an assembly of contact arms 56' and contact heads 60', which assembly includes three contact tips 62', one for each pair of contact tips 50' and 51'.

First and second upper pole studs 206 and 208 are provided which differ from upper pole studs 40 and 41 of the first embodiment in that the higher current rating requires more conductor volume for connection to an external electrical source or load. This requirement for additional conductor volume has eliminated the vertical offset between the leg portions, utilized in the first embodiment. While the vertical component of current flow between the leg portions of the pole studs 206 and 208 will not be as large, relatively speaking, as in the first embodiment, a vertical component of beneficial magnitude is still produced.

More specifically, the first metallic pole stud 206 is formed to provide a substantially S-shaped configuration when viewed from above, including first and second offset, but parallel leg portions 210 and 212, respectively, joined by an intermediate portion 214. The bottom edges of the first and second leg portions 210 and 212 are aligned. The second pole stud 208 is of like construction, except having a substantially Z-shaped configuration when viewed from above, with only the second leg portion 216 being visible in FIG. 9. Mounting brackets for mounting the upper pole studs 206 and 208 are not shown in FIGS. 8 and 9 because they would be similar to the mounting brackets 104 and 106 shown in FIGS. 4 and 5.

In the assembly of the stationary contact assembly 47', adjacent pairs of contact fingers 48' and 49' are separated on bearing member 52' by spacer washers 218. Regardless of the number of pairs of contact fingers 48' and 49', only first and second compression spacer members 148' and 150' are required, and they are placed on bearing member 52' between the outermost contact fingers 48' and 49' and the second leg portions 212 and 216 of the first and second upper pole stud members 206 and 208. Compression spacer members 148' and 150' are illustrated as being placed on bearing member 52' with an orientation opposite to the orientation used in FIG. 5, in order to indicate that orientation used does not deleteriously affect the desired function.

While only the outer contact fingers 48' and 49' are in direct contact with the compression spacer members 148' and 150', the metallic spacer washer members 218 and 140' create additional current paths which parallel the current paths between the contact fingers 48' and 49' and bearing member 52', with the current of these additional parallel paths flowing between the outermost contact fingers 48' and 49' and leg portions 212 and 216 of upper pole stud members 206 and 208 via the metallic compression spacer members 148' and 150', to reduce the current flow between the contact fingers and bearing member.

The two spaced current paths 188' and 180' form first and second legs of a first current loop 192', with current flow through legs 188 and 180 being in opposite directions. Current flow between the area of bearing member 52' and back edges of the upper pole stud, such as back edge 220, is indicated by broken lines 222 and 224. The angled current flow indicated by line 224 has vertical and horizontal components 226 and 228. Thus, as second current loop 230 is created which includes the second leg 180' and a third leg in the form of current component 226, with the current flow in legs 180' and 226 being in opposite directions. Thus, a portion of the magnetic force on the stationary contact fingers 48' and 49', created by the first current loop 192', which tends to force the movable and stationary contact structures apart, is partially compensated by an oppositely directed magnetic force on the stationary contact fingers 48' and 49', created by the second current loop 226.

In summary, there has been disclosed a power circuit breaker having an improved contact structure which: (1) eliminates the need for separate arcing contact tips; (2) which reduces the magnetic short circuit forces operating upon the relatively stationary contact assembly, while still providing a net magnetic force which aids tripping of the circuit breaker under load; and (3) which reduces the magnitude of current flowing through a pivotable joint of the relatively stationary contact assembly, at any current level.

We claim:

1. A power circuit breaker having movable and relatively stationary contact assemblies, said movable contact assembly being operable between closed and open positions relative to the stationary contact assembly, said movable and relatively stationary contact assemblies respectively having first and second conductive members having predetermined length dimensions, a main contact tip on each of the first and second conductive members, and means pivotally mounting the first and second conductive members, characterized by:

said means which pivotally mounts the second conductive member including a pivot axis which is spaced from the associated main contact tip, said first and second conductive members being disposed in spaced, substantially parallel relation when the movable contact assembly is in the closed position, to provide a first current loop having first and second legs defined by said first and second conductive members which direct current through the first and second legs in opposite directions, said means which pivotally mounts the second conductive member directing current flow in a path which provides a component of current which is spaced from and substantially parallel to the second leg of the first current loop, to provide a second current loop defined by the second leg of the first loop and a third leg formed by said current component, with current flow through the second and third legs being in opposite directions, whereby magnetic forces in the first current loop which tend to force the second leg towards the third leg, are opposed by magnetic forces in the second current loop which tend to force the second leg towards the first leg, said means which pivotally mounts the second conductive member including a fixed bearing member having first and second ends, with the second conductive member being mounted on said fixed bearing member with a snug but rotatable fit to define a first joint, first and second pole stud members, and means clamping the first and second ends of the fixed bearing member between said first and second pole stud members, to provide second and third joints, whereby a first current path includes the second conductive member, the first joint, the fixed bearing member, the second joint, and the first pole stud member, and a second current path includes the second conductive member, the first joint, the fixed bearing member, the third joint, and the second pole stud member.

2. The circuit breaker of claim 1 wherein:

the main contact tips are the only engageable contact tips carried by said first and second conductive members, the first and second conductive members each have a pivotally mounted first end and a second end, with the main contact tips each being spaced from the associated second end to define an arcing surface between each main contact tip and the associated second end, with said first and second arcing surfaces diverging from one another as they extend to their respective second ends, to stretch an arc drawn therebetween and cause the arc to run to the second ends of the first and second contact arms.

3. The circuit breaker of claim 1 wherein the second and third legs of the second current loop are effectively spaced further apart than the first and second legs of the first current loop, such that there is a net force on the second leg which tends to separate the legs of the first loop, to insure an added opening force when the circuit breaker is tripped under load.

4. The circuit breaker of claim 1 including first conductor means providing a third current path which is electrically parallel with the first current path, and second conductor means providing a fourth current path which is electrically in parallel with the second current path.

5. The circuit breaker of claim 4 wherein the first and second conductor means provide centering forces which tend to maintain the second conductive member centered on the fixed bearing member.

6. The circuit breaker of claim 4 wherein the first and second conductor means include first and second compression spacer members, respectively, with the first compression spacer member being compressed between the second conductive member and the first pole stud member, to establish the third current path directly therebetween, and with the second compression spacer member being compressed between the second conductive member and the second pole stud member, to establish the fourth current path directly therebetween, with the first and second compression spacer members providing substantially equal and opposite forces on the second conductive member which tend to center the second conductive member on the fixed bearing member.

7. The circuit breaker of claim 4 wherein the first and second conductor means respectively include first and second metallic washer members, with the first and second washer members having a substantially C-shaped cross sectional configuration, with the first C-shaped washer member being compressed between the second conductive member and the first pole stud member, to establish the third current path directly therebetween, and with the second C-shaped washer member being compressed between the second conductive member and the second pole stud member, to establish the fourth current path directly therebetween, with the first and second C-shaped washer members providing substantially equal and opposite forces on the second conductive member which tend to center the second conductive member on the fixed bearing member.

8. The power circuit breaker of claim 2 including bias means disposed to bias the second conductive member towards the first conductive member when the movable contact assembly is in the closed position thereof, with said bias means acting upon the second conductive member with a biasing force, located between the main contact tip and the second end of the second conductive member.

9. The power circuit breaker of claim 1 including an even number of second conductive members disposed in pairs, at least one first conductive member for each such pair, and including a bias spring for each pair disposed to bias the second conductive members towards the at least one first conductive member when the movable contact assembly is in the closed position thereof, with said bias means acting upon the second conductive member with a biasing force located between the main contact tip and the second end of the second conductive member.

10. A power circuit breaker having movable and relatively stationary contact assemblies, said movable contact assembly being operable between closed and open positions relative to the stationary contact assembly, said movable and relatively stationary contact assemblies respectively having first and second conductive members each having a main contact tip, said movable and relatively stationary contact assemblies each including means pivotally mounting the first and second conductive members, characterized by:

the means pivotally mounting the second conductive member includes a fixed bearing member having first and second ends, with the second conductive member being mounted on said fixed bearing member with a snug but rotatable fit to define a first joint, first and second pole stud members, means clamping the first and second ends of the fixed bearing member between said first and second pole stud members, to provide second and third joints, whereby a first current path includes the second conductive member, the first joint, the fixed bearing member, the second joint, and the first pole stud member, and a second current path includes the second conductive member, the first joint, the fixed bearing member, the third joint, and the second pole stud member, first conductor means providing a third current path which is electrically in parallel with the first current path, and second conductor means providing a fourth current path which is electrically in parallel with the second current path, said first and second conductor means respectively including first and second metallic washer members, said first and second washer members having a substantially C-shaped cross sectional configuration, said first C-shaped washer member being compressed between the second conductive member and the first pole stud member, to establish the third current path directly therebetween, said second C-shaped washer member being compressed between the second conductive member and the second pole stud member, to establish the fourth current path directly therebetween, said first and second C-shaped washer members providing substantially equal and opposite forces on the second conductive member which tend to center the second conductive member on the fixed bearing member.

11. The power circuit breaker of claim 10 including an even number of second conductive members disposed in pairs, at least one first conductive member for each such pair, and including a bias spring for each pair disposed to bias the second conductive members towards the at least one first conductive member when the movable contact assembly is in the closed position thereof.

* * * * *